US011325758B2

(12) United States Patent
Sahara et al.

(10) Patent No.: US 11,325,758 B2
(45) Date of Patent: May 10, 2022

(54) COMPOSITE CONTAINER LID

(71) Applicant: NIPPON CLOSURES CO., LTD., Tokyo (JP)

(72) Inventors: Toru Sahara, Kanagawa (JP); Takashi Sugiyama, Kanagawa (JP); Yuji Tomitaka, Kanagawa (JP); Miki Yamaoka, Kanagawa (JP)

(73) Assignee: NIPPON CLOSURES CO., LTD., Tokyo (JP)

( * ) Notice: Subject to any disclaimer, the term of this patent is extended or adjusted under 35 U.S.C. 154(b) by 329 days.

(21) Appl. No.: 16/491,943

(22) PCT Filed: Mar. 2, 2018

(86) PCT No.: PCT/JP2018/008002
§ 371 (c)(1),
(2) Date: Sep. 6, 2019

(87) PCT Pub. No.: WO2018/168523
PCT Pub. Date: Sep. 20, 2018

(65) Prior Publication Data

US 2020/0071041 A1 Mar. 5, 2020

(30) Foreign Application Priority Data

Mar. 15, 2017 (JP) ..... JP2017-049860

(51) Int. Cl.
*B65D 51/18* (2006.01)
*B65D 51/24* (2006.01)

(52) U.S. Cl.
CPC ..... *B65D 51/18* (2013.01); *B65D 51/248* (2013.01); *B65D 2251/0015* (2013.01); *B65D 2251/0075* (2013.01)

(58) Field of Classification Search
CPC ..... B65D 51/18; B65D 51/248; B65D 2251/0015; B65D 2251/0075
(Continued)

(56) References Cited

U.S. PATENT DOCUMENTS 10,457,450 B2 * 10/2019 Rios ..... A47G 19/2272
2010/0230374 A1 * 9/2010 Peters ..... B65D 1/0246 215/44

(Continued)

FOREIGN PATENT DOCUMENTS

EP 2008942 12/2008
GB 2280895 2/1995

(Continued)

OTHER PUBLICATIONS

Supplementary European Search Report for EP Application No. 18766963.5.

*Primary Examiner* — J. Gregory Pickett
*Assistant Examiner* — Niki M Eloshway
(74) *Attorney, Agent, or Firm* — Smith, Gambrell & Russell, LLP.

(57) ABSTRACT

A composite container lid includes an inner plug 1 with a flow-out port and an upper lid 3 detachably attached to a container mouth portion 80, wherein: the inner plug 1 includes an upper lid engaging cylinder 5, a container mouth portion-securing member 7 having a circumferential wall 9 that surrounds the upper lid engaging cylinder 5, and linking pieces 11 that link the inner surface of the circumferential wall 9 to the upper lid engaging cylinder 5 so as to form a flow-out port 13; the upper lid engaging cylinder 5 is provided, on the upper end portion of the outer surface thereof, with a circumferential protuberance 5*a* for temporary engagement; engaging pieces 37 are formed on the inner surface of a top plate 31 of the upper lid 3, the engaging pieces 37 having an undercut 37*a* for temporarily (Continued)

engaging with the circumferential protuberance 5*a* that temporary engages with the upper lid engaging cylinder; and a sound-suppressing protrusion 50 is provided in a region surrounded by the engaging pieces 37.

7 Claims, 5 Drawing Sheets

(58) Field of Classification Search
USPC ..... 215/329
See application file for complete search history.

(56) References Cited

U.S. PATENT DOCUMENTS

| | | | | |
|---|---|---|---|---|
| 2013/0248530 | A1* | 9/2013 | Rouquette ..... | B65D 47/123<br>220/254.1 |
| 2015/0321798 | A1* | 11/2015 | Isogai ..... | B65D 39/08<br>215/253 |

FOREIGN PATENT DOCUMENTS

| | | |
|---|---|---|
| JP | S43-3990 | 2/1968 |
| JP | S51-35453 | 3/1976 |
| JP | 51-75759 | 6/1976 |
| JP | 2014-218279 | 11/2014 |
| JP | 2015-063342 | 4/2015 |
| JP | 2015-105130 | 6/2015 |
| JP | 2016-033043 | 3/2016 |

* cited by examiner (a)

(b)

(c)

COMPOSITE CONTAINER LID

TECHNICAL FIELD

This invention relates to a composite container lid comprising an inner plug with a flow-out port fitted and secured to a container mouth portion and an upper lid detachably attached to the container mouth portion to cover the inner plug.

As a cap to be attached to a container in the form of a bottle, there has heretofore been known a composite container lid comprising an outer lid (upper lid) and an inner plug with a flow-out port.

A patent document 1, for example, is disclosing a composite container lid comprising an inner lid (inner plug) fitted and secured to a container mouth portion and an outer lid that is screw-attached to the container mouth portion so as to cover the inner lid. In this composite container lid, the inner lid has a cylindrical portion of a size that just fits into the container mouth portion. At the upper end of the cylindrical portion, there is provided a horizontal flange wall that comes into close contact with the upper end surface of the container mouth portion. A funnel-like portion (flow-out guide cylinder) that expands upwards is formed on the upper surface of the horizontal flange wall. Further, a flow-out port is formed in the bottom portion of the cylindrical portion for flowing out the content solution, and a pole-like protrusion is rising from the central portion of the bottom portion. Moreover, an annular protrusion is provided on the inner surface of the top plate of the outer lid of the composite container lid. The inner lid is held by the outer lid as the upper end of the pole-like protrusion is fitted into the annular protrusion.

The composite container lid is put to cover the container mouth portion in a state where the inner lid (inner plug) is held by the outer lid (upper lid), and is fitted to the container mouth portion as the outer lid is closed. At the time of use, the outer lid is opened and is removed from the container mouth portion leaving, however, the inner lid on the container mouth portion. Upon tilting the container, the liquid in the container flows out through the flow-out port formed in the inner lid and the funnel-like portion (flow-out guide cylinder). When the liquid content flows out by attaching the composite container lid to the container (bottle), there is obtained such an advantage that the liquid can be effectively prevented from dripping.

After the liquid content flows out by a predetermined amount, the outer lid in the composite container lid can be attached again to the container mouth portion to which the inner lid has been attached; i.e., the container mouth portion can be resealed.

When the container mouth portion is resealed with the outer lid as described, however, there often occurred a problem of defective closing.

The present inventors have forwarded the study concerning the defective closing. As a result, the inventors have discovered that a sound is generated at the time of resealing leading to the cause of defective closing.

That is, at the time of resealing in a state where the inner lid has been fitted and secured to the container mouth portion, when the outer lid that is put on the container mouth portion is descended by being turned in the closing direction, the upper end of the pole-like protrusion of the inner lid enters again into the annular protrusion provided on the inner surface of the top plate of the outer lid. In this state, as the outer lid is, further, turned in the closing direction and descends, then the undercut formed in the inner surface of the lower end of the annular protrusion moves over the upper end (swollen portion) of the pole-like protrusion. At this moment, the force of engagement of the undercut is released at one time and causes the outer lid to descend abruptly due to the reaction thereof. As a result, abrupt collision (e.g., between the screws of the outer lid and the inner lid) or slide takes place at various portions and generates the sound.

Namely, the outer lid is resealed by a general consumer. Therefore, if the sound is generated as above, then the consumer would erroneously take it that the outer lid is now completely resealed despite the outer lid would still have to be turned in the closing direction so as to be completely closed. As a result, there occurs such an inconvenience that the container is stored without the outer lid being closed to a sufficient degree.

PRIOR ART DOCUMENT

Patent Document

Patent document 1: Japanese UM-A-51-75759

OUTLINE OF THE INVENTION

Problems that the Invention is to Solve

It is, therefore, an object of the present invention to provide a composite container lid comprising an inner plug with a flow-out port fitted and secured to a container mouth portion and an upper lid detachably attached to the container mouth portion so as to cover the inner plug, wherein the composite container lid is so designed as to effectively prevent the defective closing when the upper lid is to be resealed or, in other words, to effectively suppress the production of sound when the upper lid is to be resealed.

Means for Solving the Problems

According to the present invention, there is provided a composite container lid comprising an inner plug with a flow-out port fitted and secured to a container mouth portion and an upper lid detachably attached to the container mouth portion so as to cover the inner plug, wherein:

the inner plug includes a hollow upper lid engaging cylinder with its upper end closed, a container mouth portion-securing member having a circumferential wall that surrounds the upper lid engaging cylinder, and linking pieces that link the inner surface of the circumferential wall to the upper lid engaging cylinder so as to form a flow-out port;

the upper lid engaging cylinder is provided, at an upper end on the outer surface thereof, with a circumferential protuberance for temporary engagement with the upper lid;

the upper lid includes a top plate and a skirt portion that stretches downward from the outer circumferential edge of the top plate and has, on the inner surface thereof, a screw thread for screw-engagement with the container mouth portion;

the top plate has engaging pieces formed on the inner surface thereof, the engaging pieces having an undercut for temporarily engaging with the circumferential protuberance that temporarily engages with the upper lid engaging cylinder; and a sound-suppressing protrusion is provided on the inner surface of the top plate in a region surrounded by the engaging pieces or on the upper end surface of the upper lid engaging cylinder.

In the composite container lid of the present invention, the following embodiments can be favorably employed.

(1) The sound-suppressing protrusion is an annular protrusion formed on the inner surface of the top plate of the upper lid;

(2) The engaging pieces are circumferentially formed being divided into a plurality of segments maintaining a distance;

(3) The container mouth portion-securing member includes, in addition to the circumferential wall, an annular outer wall and a horizontal wall linking the circumferential wall to the annular outer wall, permits the upper part of the container mouth portion to be fitted and secured in space between the circumferential wall and the annular outer wall, and has an undercut formed in the inner surface at the lower end of the annular outer wall to engage with the outer surface at the upper end part of the container mouth portion;

(4) The inner plug is attached to the container mouth portion together with the upper lid when the upper lid engaging cylinder is temporarily held by the upper lid by being inserted in the region surrounded by the engaging pieces of the upper lid and when the upper lid in this state is descended while being put on the container mouth portion, the inner plug remaining on the container mouth portion despite the upper lid is opened and is removed from the container mouth portion;

(5) A gap is maintained between the lower side surface of the screw thread of the upper lid skirt portion for screw engagement and the outer surface of the container mouth portion when the sound-suppressing protrusion starts coming in contact with the upper end surface of the upper lid engaging cylinder or with the inner surface of the top plate of the upper lid accompanying the descending motion of the upper lid;

(6) The container mouth portion-securing member of the inner plug is provided with a flow-out guide cylinder that stretches upward, and a seal ring is formed on the inner surface of the top plate of the upper lid to come into close contact with the inner surface of the flow-out guide cylinder when the upper lid is closed; and (7) The top plate of the upper lid is provided, on the inner surface thereof, with a protrusion for preventing overwrap-seaming of the upper lid.

Effects of the Invention

In the composite container lid of the invention, an important feature resides in the provision of the sound-suppressing protrusion on the inner surface of the top plate of the upper lid in a region surrounded by the engaging pieces or on the upper end surface of the upper lid engaging cylinder.

The sound-suppressing protrusion is for shortening the distance between the upper end surface of the upper lid engaging cylinder and the inner surface of the top plate of the upper lid, and works to suppress the generation of sound. That is, let it be presumed a case where the upper lid was once opened and it is now attempted to seal the container mouth portion again with the upper lid that was removed therefrom. In this case, the upper lid is put on the container mouth portion to which the inner plug has been fitted and secured. The upper lid is then turned in the closing direction. Here, first, the upper end of the upper lid engaging cylinder of the inner plug enters into the region surrounded by the engaging pieces formed on the inner surface of the top plate of the upper lid. Thereafter, as the upper lid is further turned in the closing direction so as to be descended, then the upper end of the upper lid engaging cylinder moves over the undercut of the engaging pieces. In the conventional composite container lid, at this moment, the engaging force (resistance against being closed) due to the undercut is released. Due to the reaction thereof, therefore, the upper lid descends abruptly permitting the screw thread of the upper lid to come into contact with the screw thread of the container mouth portion at one time generating, therefore, the sound. According to the present invention, however, the sound-suppressing protrusion effectively suppresses the generation of sound.

Namely, in the present invention, the distance between the upper end surface of the upper lid engaging cylinder and the inner surface of the top plate of the upper lid is adjusted by the sound-suppressing protrusion to be short. Therefore, when the upper end of the upper lid engaging cylinder moves over the undercut of the engaging pieces, the sound-suppressing protrusion readily restricts the upper end surface of the upper lid engaging cylinder. Besides, even when the engaging force (pushing force) of the undercut is released, a resisting force generates against closing the container mouth portion. As a result, even when the engaging force due to the undercut is released, the upper lid is suppressed from abruptly descending, and the screw threads are prevented from coming into quick contact with each other effectively suppressing the generation of sound.

As described above, the present invention effectively suppresses the generation of sound when it is attempted to reseal the upper lid. Accordingly, the general consumers are allowed to reliably reseal the upper lid up to the completely closed position eliminating such an inconvenience that the consumers may discontinue the closing attempt due to the generation of sound and, therefore, that the container is stored with its upper lid imperfectly closed.

MODES FOR CARRYING OUT THE INVENTION

Figure 1:
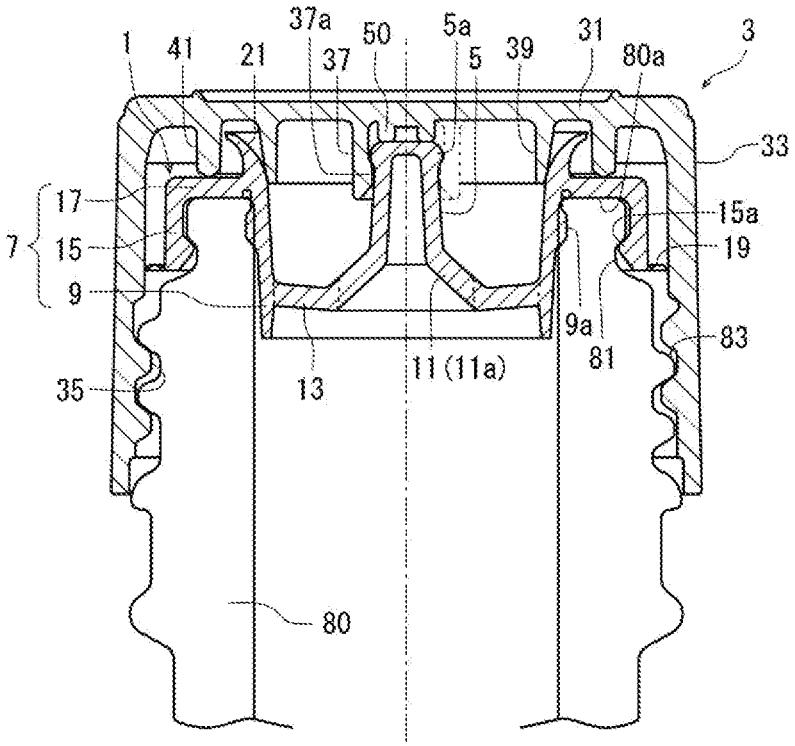
FIG. 1 It is a side sectional view illustrating a state where a composite container lid of the present invention is closing a container mouth portion.
Figure 2:
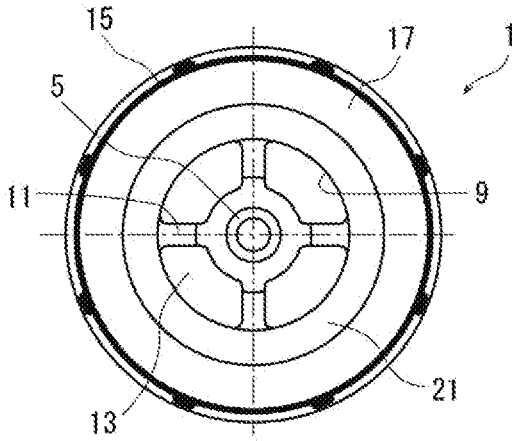
FIG. 2 It is a view showing an inner plug in the composite container lid of FIG. 1, wherein (a) is a top view, (b) is a half-sectional side view, and (c) is a bottom view.
Figure 2:
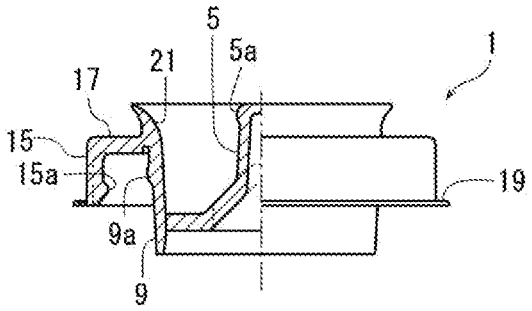
Figure 2:
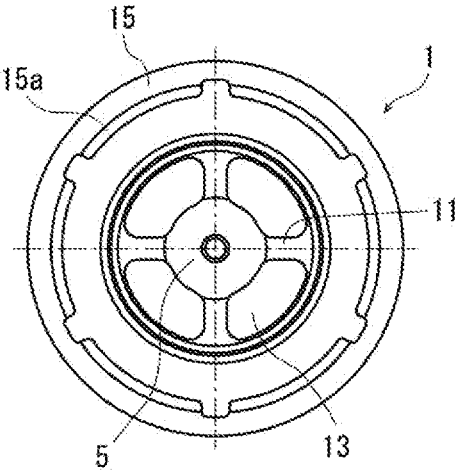
Figure 3:
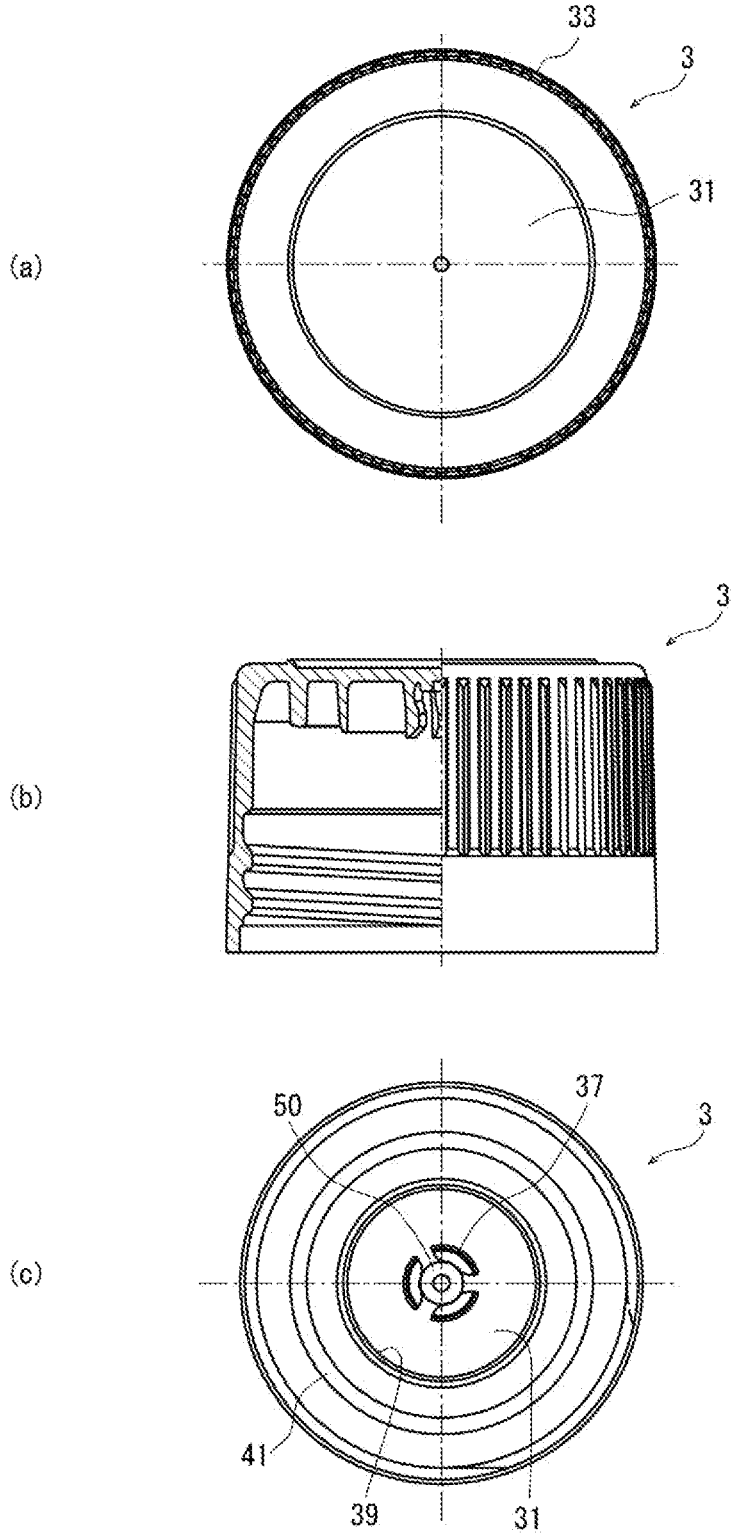
FIG. 3 It is a view showing an upper lid in the composite container lid of FIG. 1, wherein (a) is a top view, (b) is a half-sectional side view, and (c) is a bottom view.

Reference is now made to FIG. 1 illustrating a state where a composite container lid of the present invention is closing a container mouth portion, FIG. 2 illustrating an inner plug and FIG. 3 illustrating an upper lid. The composite container lid includes an inner plug 1 and an upper lid 3, and is attached to a container mouth portion designated at 80.

The container mouth portion 80 is forming, in the outer surface thereof, a recessed portion 81 for holding the inner plug 1 at an upper part thereof, and is, further, forming a screw 83 for screw-fixing the upper lid 3 at a portion under the recessed portion 81.

The composite container lid is attached to the container mouth portion 80 in a state where the inner plug 1 is held by the upper lid 3 by putting the upper lid 3 on the mouth portion 80 of the container that is containing a liquid content to close the mouth portion (i.e., by turning the upper lid 3 in a closing direction).

The inner plug 1 is constituted by a hollow upper lid engaging cylinder 5 and with its upper end closed, and a container mouth portion-fixing member 7. That is, the upper lid engaging cylinder 5 is a member that engages with the upper lid 3 to hold it while the container mouth portion-fixing member 7 is a member that works to bring the inner plug 1 into firm and close contact with the container mouth portion 80 to fix it thereto.

The upper lid engaging cylinder 5 is a member that temporarily engages with engaging pieces 37 (described later) formed on the inner surface of the upper lid 3, and is forming, at the upper end thereof, a circumferential protuberance 5*a* for temporary engagement in a shape that is swollen outward. As shown in FIGS. 1 and 2, the upper lid engaging cylinder 5 has a hollow shape with its upper end closed, and assumes such a shape that easily deflects inward. Therefore, the upper lid engaging cylinder 5 is capable of easily engaging with the upper lid 3 to hold it. As viewed on the side surface, furthermore, the upper lid engaging cylinder 5 as a whole is tapered with its diameter contracting from the lower side toward the upper side. Due to this shape, too, the upper lid engaging cylinder 5 easily engages with the upper lid 3 to hold it.

How to engage with the upper lid 3 to hold it will be described later.

The container mouth portion-fixing member 7 includes a circumferential wall 9 that is so provided as to surround the upper lid engaging cylinders. The circumferential wall 9 forms, on the outer surface thereof, a swollen portion 9*a* that slightly swells outward (see FIG. 2(*b*)). The swollen portion 9*a*, therefore, comes into close contact with the inner surface of the container mouth portion 80 as shown in FIG. 1. As shown in FIGS. 2(*a*) and (*c*), further, the inner surface of the circumferential wall 9 is linked to the lower end of the upper lid engaging cylinder 5 via a plurality of linking pieces 11 that are formed maintaining a predetermined distance. Therefore, spaces among the linking pieces 11 serve as a plurality of flow-out ports 13 for flowing out the liquid content.

As will be understood from FIGS. 1 and 2 (*b*), the linking pieces 11 have regions 11*a* that are tilted downward and outward from the lower end of the upper lid engaging cylinder 5. Therefore, the linking pieces 11 can be easily deflected, eventually, permitting the upper lid engaging cylinder 5 to move up and down to some extent.

The container mouth portion-fixing member 7, further, has a low annular outer wall 15 in addition to the above circumferential wall 9, the upper inner surface of the annular outer wall 15 being continuous to the upper outer surface of the circumferential wall 9 via a horizontal wall 17.

As will be understood from FIG. 1, the upper end portion of the container mouth portion 80 is fitted into the space between the annular outer wall 15 and the circumferential wall 9. To do so, an undercut 15*a* is formed in the inner surface at the lower end of the annular outer wall 15. The undercut 15*a* comes into a firm engagement with a recessed portion 81 formed in the outer surface of the container mouth portion 80. Namely, due to the undercut 15*a* and the swollen portion 9*a* formed on the outer surface of the circumferential wall 9, the inner plug 1 is reliably fitted and fixed to the container mouth portion 80, and is held thereby in a state where the lower surface of the horizontal wall 17 is in close contact with the upper end surface 80*a* of the container mouth portion 80.

A rattling-prevention piece 19 is provided on the outer surface at the lower end of the annular outer wall 15. Therefore, the inner plug 1 held in the upper lid 3 prior to being attached to the container mouth portion 80, is allowed to be held therein maintaining stability without rattling in the upper lid 3. This prevents the inner plug from falling down prior to being attached to the container mouth portion 80, and is also effective in attaining alignment with respect to the container mouth portion 80. The rattling-prevention piece 19 is simply for preventing the rattling and, therefore, may be formed in a small thickness so as to easily deflect.

In this embodiment as shown in FIGS. 1 and 2(*b*), further, a flow-out guide cylinder 21 is stretching upward together with the circumferential wall 9. The flow-out guide cylinder 21 works as a passage for guiding the solution contained in the container when it is flown out through the flow-out ports 13. The flow-out guide cylinder 21 is expanding like a horn at its upper end. Upon employing the above shape, the flow-out guide cylinder 21 becomes capable of sharply discontinuing the flow out of the liquid content and suppressing the liquid content from dripping.

Here, the flow-out guide cylinder 21 does not have to be directly stretched from the upper end of the circumferential wall 9, but may be erected on the upper surface of the horizontal wall 17 maintaining a gap from the upper end of the circumferential wall 9.

In the inner plug 1 described above, the annular outer wall 15 may be omitted, and the container mouth portion-fixing member 7 may be constituted by the circumferential wall 9 and the horizontal wall 17 only. In order for the inner plug 1 to be firmly fitted and fixed to the container mouth portion 80, however, it is desired to provide the above-mentioned annular outer wall 15.

Referring to FIGS. 1 and 3, the upper lid 3 includes a top plate 31 and a skirt portion 33 stretching downward from the outer circumferential edge of the top plate 31. On the inner surface of the skirt portion 33, there is formed a screw thread 35 that engages with a screw 83 formed on the container mouth portion 80.

By utilizing the engagement of the screw thread 35 with the screw 83, the thus formed upper lid 3 is detachably attached to the container mouth portion 80 so as to cover the inner plug 1 fitted and fixed to the container mouth portion 80.

On the inner surface of the top plate 31 of the upper lid 3, there are provided a plurality of (three in the diagramed embodiment) separate engaging pieces 37 stretching downward from the central portion thereof. The engaging pieces 37 are for holding the inner plug 1 in the upper lid 3. Namely, the plurality of engaging pieces 37 are circumferentially arranged, and the upper portion of the upper lid engaging cylinder 5 is inserted in a region surrounded by the engaging pieces 37. Besides, at the lower end of each engaging piece 37, there is formed an undercut 37*a* that is capable of engaging with the circumferential protuberance 5*a* for temporary engagement formed at the upper end of the upper lid engaging cylinder 5. As the circumferential protuberance 5*a* and the undercut 37*a* engage with each other, the inner plug 1 is stably held so will not to be removed from the upper lid 3.

It is in principle possible to hold the inner plug 1 in the upper lid 3 by inserting the upper part of the upper lid engaging cylinder 5 in space in a ring by using an engaging piece of a ring shape instead of using the plurality of engaging pieces 37 lacking, however, the practicability. This is because the engaging piece of the ring shape easily undergoes the deflection, and it becomes difficult to insert the upper lid engaging cylinder 5 in the space in the ring. Further, if the inner diameter of the ring is increased to facilitate the insertion of the upper lid engaging cylinder 5, then it becomes difficult to stably hold the upper lid engaging cylinder 5 that is inserted.

Therefore, the number of the engaging pieces 37 and the size (diameter) of the region surrounded by the engaging pieces 37 should be determined depending on the size of the upper end of the upper lid engaging cylinder 5 such that the upper lid engaging cylinder 5 is allowed to enter as the engaging pieces 37 are deflected and that the undercut 37*a* and the circumferential protuberance 5*a* work together to stably hold the upper lid engaging cylinder 5 so will not to escape.

On the inner surface of the top plate 31 of the upper lid 3, further, a cylindrical seal ring 39 is provided on the outer side of the engaging piece 37. As shown in FIG. 1, when the upper lid 3 is attached to the container mouth portion 80, the seal ring 39 comes into close contact with the inner surface of the flow-out guide cylinder 21 assuring the sealing property so that the content solution does not leak.

On the inner surface of the top plate 31, furthermore, an over-wrap-seam prevention protrusion 41 is formed along the circumference thereof on the outer side of the seal ring 39. The protrusion 41 is a member that comes into contact with the upper surface of the horizontal wall 17 of the inner plug 1 when the upper lid 3 is in its closing motion; i.e., the protrusion 41 blocks excess of closing motion (wrap-seaming) to let the consumer know that the mouth portion has been completely closed.

By using the above-mentioned composite container lid, the upper part of the upper lid engaging cylinder 5 of the inner plug 1 is pushed into the region surrounded by the engaging pieces 37 of the upper lid 3, and the inner plug 1 is held by the upper lid 3. In this state, the upper lid 3 is put on the mouth portion 80 of the container filled with the content solution; i.e., the composite container lid is attached to the container mouth portion 80.

That is, due to the engagement (temporary engagement) of the undercut 37*a* of the engaging pieces 37 with the circumferential protuberance 5*a* at the upper end of the upper lid engaging cylinder 5, the inner plug 1 is not removed from the upper lid 3 enabling the closing operation to be quickly carried out.

As the upper lid 3 descends accompanying the closing operation, the upper part of the container mouth portion 80 is fitted to between the circumferential wall 9 of the inner plug 1 and the annular outer wall 15, whereby the outer surface (swollen portion 9*a*) of the circumferential wall 9 comes into close contact with the inner surface of the container mouth portion, and the lower surface of the horizontal wall 17 of the inner plug 1 comes into close contact with the upper end surface 80*a* of the container mouth portion 80. In this state where the sealing property is maintained, the inner plug 1 is firmly fixed to the container mouth portion 80.

In the above-mentioned composite container lid of the present invention, a sound-suppressing protrusion 50 is provided on the inner surface of the top plate 31 of the upper lid 3. This effectively suppresses the generation of sound when the upper lid 3 removed from the container mouth portion 80 is to be resealed. Namely, this effectively prevents such an occurrence that a consumer might misunderstand the generation of sound as the completion of the closing operation (i.e., prevents defective closing).

To flow out the liquid content from the container, a general consumer would remove the upper lid 3 from the container mouth portion 80 by turning the upper lid 3 in the opening direction in a state where the composite container lid has been attached to the container mouth portion 80 as shown in FIG. 1. In this case, the inner plug 1 has been firmly fitted and secured to the container mouth portion 80. As the upper lid 3 rises, therefore, the upper part of the upper lid engaging cylinder 5 is pulled out from the region surrounded by the engaging pieces 37 of the upper lid 3 and, accordingly the upper lid 3 only is removed from the container mouth portion 80. Upon tilting the container, therefore, the liquid content flows through the flow-out port 13 and flows out along the wall surface of the flow-out guide cylinder 21. After the liquid content is flown out by a predetermined amount, the container is returned it its upright state. The upper lid 3 that is removed is put on the container mouth portion 80 in which the inner plug 1 has been secured. The upper lid 3 is then turned in the closing direction so as to be attached to the container mouth portion 80 again.

Figure 4:
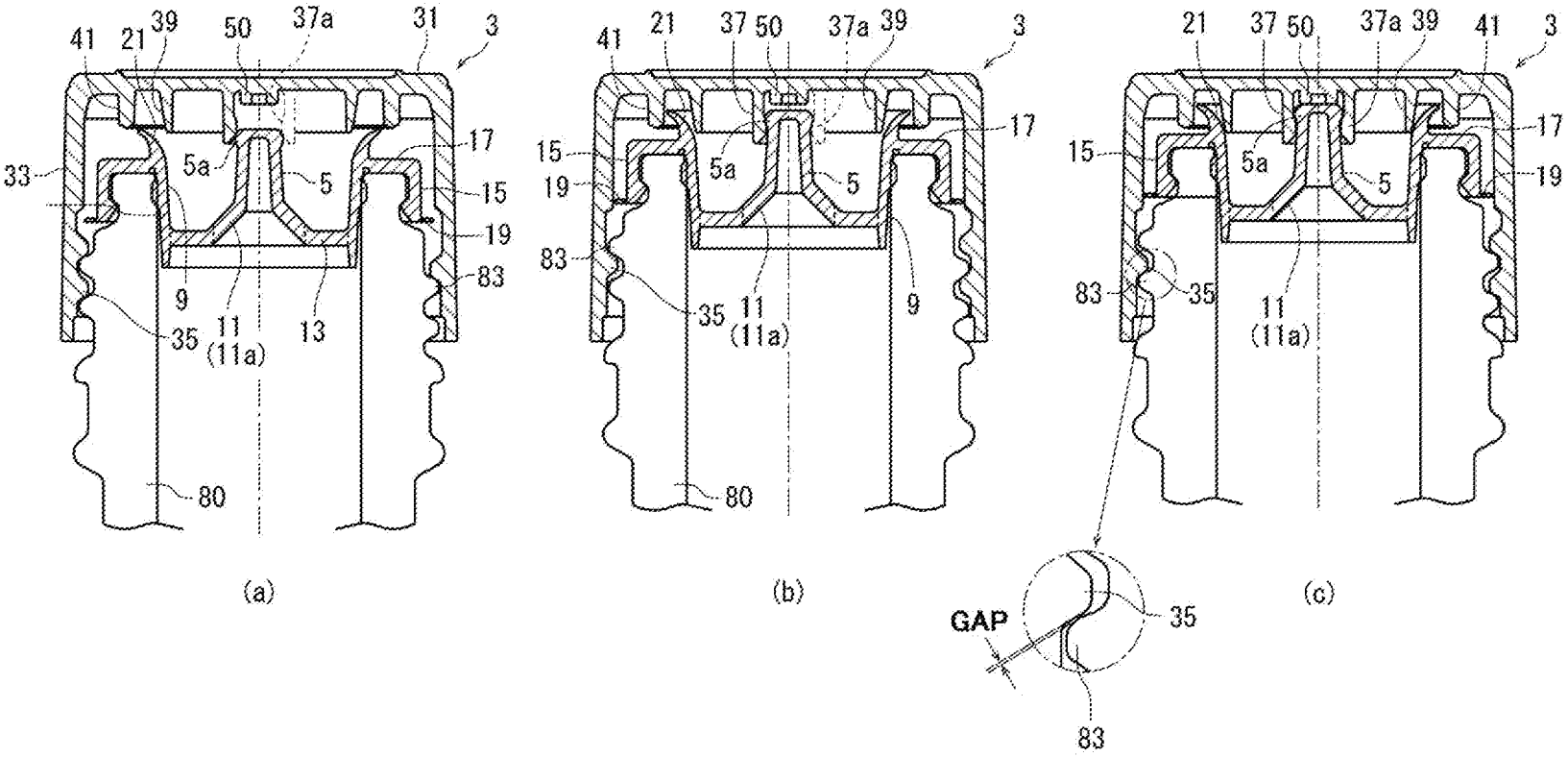
FIG. 4 It is a view illustrating the steps of resealing with the upper lid using the composite container lid of FIG. 1, wherein (a) illustrates the initial state of resealing, (b) illustrates a state where an undercut of engaging pieces is moving on an upper end portion (circumferential protuberance for temporary engagement) of an upper lid engaging cylinder, and (c) illustrates a state where the undercut has moved on the upper end portion of the upper lid engaging cylinder.

Reference is now made to FIG. 4 which illustrates the resealing operation.

In FIG. 4, as the upper lid 3 is put on the container mouth portion 80 to close it, the undercut 37*a* at the lower end of the engaging pieces 37, first, comes in contact with the circumferential protuberance 5*a* at the upper end of the upper lid engaging cylinder 5 of the inner plug 1 (see FIG. 4(*a*)). At this step, the over-wrap-seaming prevention protrusion 41 has been greatly separated away from the upper surface of the horizontal wall 17 and, besides, there exists a large gap between the seal ring 39 and the inner surface of the flow-out guide cylinder 21. Moreover, the sound-suppressing protrusion 50, too, is positioned being considerably separated away from the upper end surface of the upper lid engaging cylinder 5.

In this state, as the upper lid 3 is further turned in the closing direction, the undercut 37*a* rides on the circumferential protuberance 5*a* of the upper lid engaging cylinder 5, and the pushing force acts on the upper lid engaging cylinder 5 (hereinafter often referred to simply as cylinder 5) due to the upper lid 3 that is descending (see FIG. 4(*b*)). Even in this state, the gap is still large between the over-wrap-seaming prevention protrusion 41 and the upper surface of the horizontal wall 17. Therefore, the seal ring 39 is separated away from the inner surface of the flow-out guide cylinder 21, and the sound-suppressing protrusion 50, too, remains considerably separated away from the upper end surface of the upper lid engaging cylinder 5.

As the upper lid 3 is further turned in the closing direction, the cylinder 5 is gradually pushed down accompanying the upper lid 3 (engaging pieces 37) that descends, and the undercut 37*a* of the engaging pieces 37 moves over the circumferential protuberance 5*a* of the cylinder 5 (see FIG. 4(*c*)). This is because the linking pieces 11 linking the cylinder 5 to the circumferential wall 9 undergo the deflection and become tilted outward from the lower end of the cylinder 5 and, besides, the cylinder 5 is hollow and easily undergoes the deflection.

In this state, the over-wrap-seaming prevention protrusion 41 remains separated away from the upper surface of the horizontal wall 17 and, besides, a gap still exists between the seal ring 39 and the inner surface of the flow-out guide cylinder 21. It will, therefore, be understood that the closing operation has not yet been completed. Here, however, the sound-suppressing protrusion 50 provided on the upper lid 3 is in a state of being contacted to the upper end surface of the upper lid engaging cylinder 5 making it, therefore, possible to effectively suppress the generation of sound when the undercut 37*a* of the engaging pieces 37 has moved over the circumferential protuberance 5*a* of the cylinder 5.

Figure 5:
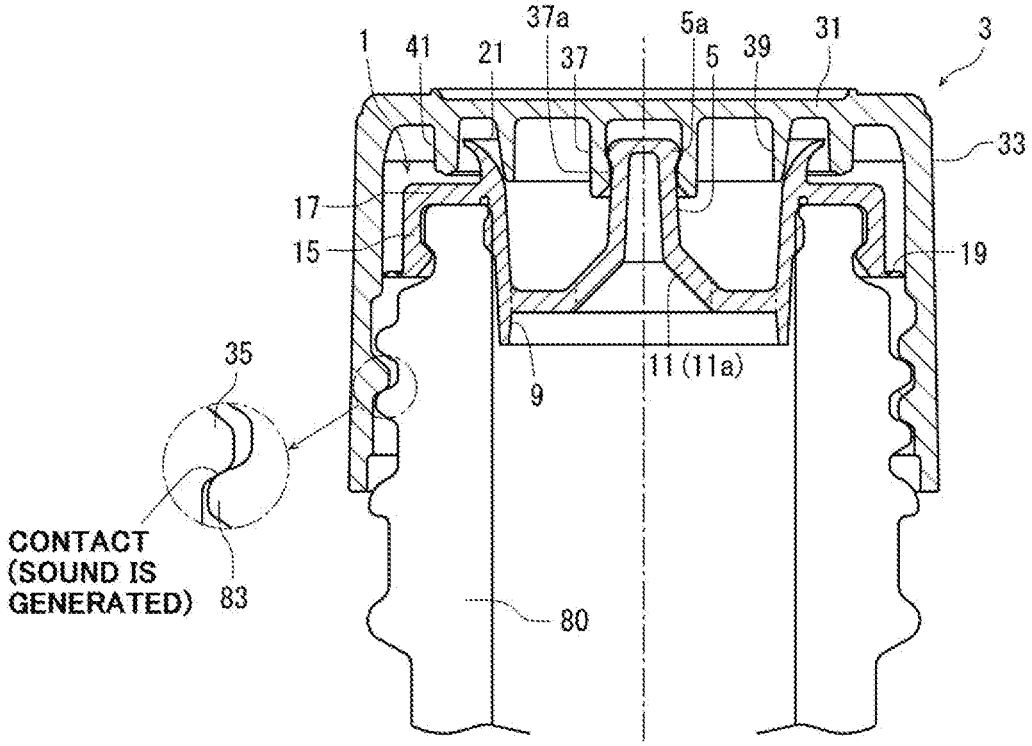
FIG. 5 It is a view illustrating a state where the undercut of the engaging pieces has moved over the upper end part of the upper lid engaging cylinder in the composite container lid of a form that has no sound-suppressing protrusion employed by the present invention.

FIG. 5 illustrates a composite container lid without the sound-suppressing protrusion 50 at a moment when the undercut 37*a* of the engaging pieces 37 has moved over the circumferential protuberance 5*a* of the cylinder 5. As will be obvious, when there is formed no sound-suppressing protrusion 50, the upper end surface of the cylinder 5 in this state is separating away from the inner surface of the top plate 31. Here, when the undercut 37*a* of the engaging pieces 37 moves over the circumferential protuberance 5*a* of the cylinder 5, the engagement between the undercut 37*a* and the circumferential protuberance 5*a* is released at one time. Due to the reaction thereof, therefore, the upper lid 3 descends abruptly. As a result, the lower surface of the screw thread 35 of the skirt portion 33 of the upper lid 3 comes in contact with the upper surface of the screw 83 of the container mouth portion 80 to generate sound.

As the sound is generated, a general consumer would erroneously take it that the closing operation has been completed and may discontinue the closing operation. At this moment as described above, however, the closing operation has not been completed yet and there may occur a problem of defective closing.

Referring to FIG. 4(*c*) again, according to the present invention, provision is made of the sound-suppressing protrusion 50. At a moment when the undercut 37*a* of the engaging pieces 37 has moved over the circumferential protuberances 5*a* of the cylinder 5, therefore, the sound-suppressing protuberance 50 is in contact with the upper end surface of the cylinder 5. Therefore, the reaction due to the engaging force that is released, is effectively restricted, and the state of contact between the sound-suppressing protrusion 50 and the upper end of the cylinder 5 serves as resisting force against the closing operation. This prevents the upper lid 3 from abruptly descending and, therefore, also prevents the contact between the screw thread 35 and the screw 83. For instance, a gap is present between the lower surface of the screw thread 35 and the upper surface of the screw 83.

No sound is now generated at the moment when the undercut 37*a* of the engaging pieces 37 moves over the circumferential protuberance 5*a* of the cylinder 5. Therefore, the consumer would continue to turn the upper lid 3 in the closing direction to fulfil the closing. As shown in FIG. 1, therefore, the upper lid 3 descends in a state where the sound-suppressing protrusion 50 is in contact with the upper end of the cylinder 5. Thereafter, the over-wrap-seaming prevention protrusion 41 comes in contact with the upper surface of the horizontal wall 17. Moreover, the seal ring 39 comes in close contact with the inner surface of the flow-out guide cylinder 21 to thereby complete the closing operation. Here, the cylinder 5 is urged downward by the sound-suppressing protrusion 50 of the upper lid 3, the linking pieces 11 are deflected downward, and the cylinder 5 by itself assumes a slightly descended state.

In the invention described above, it is in theory possible to suppress the generation of sound without providing the sound-suppressing protrusion 50 but permitting the inner surface of the top plate 31 to come into contact with the upper end surface of the cylinder 5 when the undercut 37*a* has moved over the circumferential protuberance 5*a*. In fact, however, it is quite difficult to so design that the gap becomes zero at the time of temporary engagement. Besides, permitting the inner surface of the top plate 31 to come into direct contact with the upper end surface of the cylinder 5 causes a great increase in the resisting force against the closing operation; i.e., it becomes difficult to close the container mouth portion. Therefore, it is not allowable to employ the means that brings the inner surface of the top plate 31 into direct contact with the upper end surface of the cylinder 5.

In the embodiment described above, the sound-suppressing protrusion 50 is in contact with the upper end surface of the cylinder 5 when the undercut 37*a* has moved over the circumferential protuberance 5*a*. Generation of sound, however, can be suppressed to a considerable degree if rise of the cylinder 5 is limited to a certain degree despite of the reaction caused by the release of engagement. Therefore, the present invention is not limited to only the embodiment in which the sound-suppressing protrusion 50 is in contact with the upper end surface of the cylinder 5 but may also be so modified that a small gap is maintained between them.

The sound-suppressing protrusion 50 is a member that adjusts the gap to the upper end surface of the cylinder 5 and restricts the rise of the cylinder 5 caused by the reaction. In the embodiment of the drawings, therefore, the sound-suppressing protrusion 50 is an annular protrusion of the shape of a ring. As far as the resisting force against the closing operation is not excessively increased by the contact of the cylinder 5, therefore, the sound-suppressing protrusion 50 is not limited to the above-mentioned shape only, but may assume a solid form or may assume the form of a plurality of fine projections.

Furthermore, it is also allowable to form the sound-suppressing protrusion 50 on the upper end surface of the upper lid engaging cylinder 5 instead of forming it on the inner surface of the top plate 31.

In the invention, further, in order to further improve the effect for suppressing the generation of sound, it is desired not to provide any protuberance that engages with the rattle-prevention piece 19 on the inner surface of the skirt portion 33 of the upper lid 3 to which the outer circumferential edge of the rattle-prevention piece 19 faces. Specifically, it is desired not to provide any protuberance that engages with the rattle-prevention piece 19 on the surface to which the rattle-prevention piece 19 faces until the engagement is released between the upper lid engaging cylinder 5 and the engaging pieces 37. This is because any protuberance formed on this portion may generate sound as the rattle-prevention piece 19 comes in contact therewith or is released therefrom.

According to the present invention, generation of sound is effectively suppressed at the time when the upper lid 3 is to be resealed making it possible to effectively prevent defective sealing caused by an incomplete closing.

DESCRIPTION OF REFERENCE NUMERALS

1: inner plug
3: upper lid
5: upper lid engaging cylinder
7: container mouth portion-securing member
9: circumferential wall
11: linking pieces

13: flow-out port
15: annular outer wall
17: horizontal wall
19: rattle-prevention piece
21: flow-out guide cylinder
31: top plate
33: skirt portion
35: screw thread
37: engaging pieces
39: seal ring
41: over-wrap-seaming prevention protrusion
50: sound-suppressing protrusion
80: container mouth portion

The invention claimed is:

1. A composite container lid including an inner plug with a flow-out port fitted and secured to a container mouth portion and an upper lid detachably attached to the container mouth portion so as to cover said inner plug, wherein:

said inner plug includes a hollow upper lid engaging cylinder with a closed upper end, a container mouth portion-securing member having a circumferential wall that surrounds said upper lid engaging cylinder, and linking pieces that link an inner surface of said circumferential wall to said upper lid engaging cylinder so as to form a flow-out port;

said upper lid engaging cylinder is provided, at an upper end on an outer surface thereof, with a circumferential protuberance for temporary engagement with said upper lid;

said upper lid includes a top plate and a skirt portion that stretches downward from an outer circumferential edge of said top plate and that has, on an inner surface thereof, a screw thread for screw-engagement with the container mouth portion;

said top plate has engaging pieces formed on an inner surface thereof, said engaging pieces having an undercut for temporarily engaging with said circumferential protuberance that temporarily engages with said upper lid engaging cylinder;

a sound-suppressing protrusion is provided on said inner surface of said top plate in a region that is surrounded by said engaging pieces, or on said upper end surface of said upper lid engaging cylinder; and during descending motion of said upper lid, a gap is maintained between a lower side surface of said screw thread of said upper lid skirt portion and the outer surface of the container mouth portion when said sound-suppressing protrusion starts coming into contact with said upper end surface of said upper lid engaging cylinder or with said inner surface of said top plate of said upper lid.

2. The composite container lid according to claim 1, wherein said sound-suppressing protrusion is an annular protrusion formed on said inner surface of said top plate of said upper lid.

3. The composite container lid according to claim 1, wherein said engaging pieces are circumferentially formed as divided into a plurality of segments maintaining a distance.

4. The composite container lid according to claim 1, wherein said container mouth portion-securing member includes, in addition to said circumferential wall, an annular outer wall and a horizontal wall linking said circumferential wall to said annular outer wall, said horizontal wall permitting an upper part of the container mouth portion to be fitted and secured in a space between said circumferential wall and said annular outer wall, and said annular outer wall having an undercut formed in an inner surface at a lower end of said annular outer wall to engage with an outer surface at the upper end part of the container mouth portion.

5. The composite container lid according to claim 1, wherein said inner plug is attached to the container mouth portion together with said upper lid when said upper lid engaging cylinder is temporarily held by said upper lid by being inserted in said region surrounded by said engaging pieces of said upper lid and when said upper lid in this state descends while being put on the container mouth portion, said inner plug remaining on the container mouth portion despite said upper lid being opened and removed from the container mouth portion.

6. The composite container lid according to claim 1, wherein said container mouth portion-securing member of said inner plug is provided with a flow-out guide cylinder that stretches upward, and a seal ring is formed on said inner surface of said top plate of said upper lid to come into close contact with an inner surface of said flow-out guide cylinder when said upper lid is closed.

7. The composite container lid according to claim 1, wherein said top plate of said upper lid is provided, on said inner surface thereof, with a protrusion for preventing over-wrap-seaming of said upper lid.

* * * * *